US010215530B1

(12) United States Patent
Watts et al.

(10) Patent No.: US 10,215,530 B1
(45) Date of Patent: Feb. 26, 2019

(54) LASER FIREARM SIGHT APPARATUS

(71) Applicants: Anthony Watts, Paris, AR (US); Cory Hamilton, Paris, AR (US)

(72) Inventors: Anthony Watts, Paris, AR (US); Cory Hamilton, Paris, AR (US)

( * ) Notice: Subject to any disclaimer, the term of this patent is extended or adjusted under 35 U.S.C. 154(b) by 0 days.

(21) Appl. No.: 15/963,050

(22) Filed: Apr. 25, 2018

Related U.S. Application Data

(60) Provisional application No. 62/489,901, filed on Apr. 25, 2017.

(51) Int. Cl.

| | |
|---|---|
| ***F41G 1/00*** | (2006.01) |
| ***F41G 1/54*** | (2006.01) |
| ***F41G 1/35*** | (2006.01) |
| ***F41G 1/36*** | (2006.01) |
| ***F41G 11/00*** | (2006.01) |

(52) U.S. Cl.
CPC ..... *F41G 1/35* (2013.01); *F41G 1/36* (2013.01); *F41G 11/001* (2013.01)

(58) Field of Classification Search
CPC ..... F41G 1/35; F41G 1/36; F41G 1/54; F41G 1/545; F41G 11/003
USPC ..... 42/114–117
See application file for complete search history.

(56) References Cited

U.S. PATENT DOCUMENTS 4,825,258 A * 4/1989 Whitson ..... F41G 1/54 33/286
5,365,669 A * 11/1994 Rustick ..... F41A 33/02 33/DIG. 21
5,432,598 A * 7/1995 Szatkowski ..... F41G 1/545 356/153
5,448,834 A * 9/1995 Huang ..... F41G 1/545 279/2.12
5,454,168 A * 10/1995 Langner ..... F41G 1/545 356/153
5,486,913 A * 1/1996 Aharon ..... F41G 1/545 356/153
5,618,099 A * 4/1997 Brubacher ..... F41G 1/545 362/111
6,295,753 B1 * 10/2001 Thummel ..... F41A 33/02 42/116
6,622,414 B1 * 9/2003 Oliver ..... F41A 33/02 42/116
6,715,395 B1 * 4/2004 Heibel ..... F41A 19/58 180/287
6,796,480 B1 * 9/2004 Powers ..... B23K 1/0016 228/103
7,032,341 B1 * 4/2006 Sconce ..... F41G 1/18 42/111
7,677,893 B2 * 3/2010 Lvovskiy ..... F41A 33/02 42/41

(Continued)

*Primary Examiner* — Michael D David
(74) *Attorney, Agent, or Firm* — Rashauna Norment

(57) ABSTRACT

The present invention is a laser firearm sight apparatus that has a housing attachable onto the external threads of a firearm muzzle, a light source having at least two lasers emitting laser beams, and an activating mechanism for activating and powering the light source. The housing defines a longitudinal bore for universal attachment onto several different muzzles of different types of firearms of the same caliber barrel while keeping the laser sight accurate within an acceptable range without further adjustment. The lasers emit a beam that is concentric and parallel with the muzzle and bore of the firearm.

16 Claims, 11 Drawing Sheets

(56) References Cited

U.S. PATENT DOCUMENTS 7,856,729 B1 * 12/2010 Pinto ..... F41A 31/02 33/286
7,900,391 B1 * 3/2011 Mihelish ..... F41A 31/02 42/116
8,091,267 B2 * 1/2012 Moore ..... F41G 1/35 362/259
8,127,485 B2 * 3/2012 Moore ..... F41G 1/35 42/114
8,132,354 B1 * 3/2012 Sellers ..... F41G 1/54 42/116
8,312,665 B2 * 11/2012 Moore ..... F41G 1/35 42/114
8,510,981 B1 * 8/2013 Ganther ..... F41G 1/545 42/121
8,607,495 B2 * 12/2013 Moore ..... F41G 1/36 42/114
8,627,591 B2 * 1/2014 Moore ..... F41G 11/003 42/114
8,661,725 B1 * 3/2014 Ganther ..... F41G 1/545 42/119
8,695,266 B2 * 4/2014 Moore ..... F41G 1/54 356/249
8,696,150 B2 * 4/2014 Moore ..... F41G 1/35 362/110
8,739,677 B1 * 6/2014 Robbins ..... F41G 1/545 42/121
8,826,582 B2 * 9/2014 Bowman ..... F41G 1/00 42/115
8,844,189 B2 * 9/2014 Moore ..... F41G 1/35 362/259
9,170,079 B2 * 10/2015 Moore ..... F42B 8/02
9,182,194 B2 * 11/2015 Moore ..... F41C 23/16
9,297,614 B2 * 3/2016 Moore ..... F41G 1/35
9,513,086 B2 * 12/2016 Wenn ..... F41G 3/323
9,638,491 B2 * 5/2017 Challis ..... F41C 23/16
9,638,493 B2 * 5/2017 Bowman ..... F41G 1/35
9,644,826 B2 * 5/2017 Moore ..... F21V 23/04
9,829,280 B1 * 11/2017 Moore ..... F41G 3/2655

* cited by examiner

LASER FIREARM SIGHT APPARATUS

CROSS-REFERENCE TO RELATED APPLICATIONS

This application claims the benefit of and priority to U.S. Provisional Application No. 62/489,901, filed Apr. 25, 2017, and the provisional application is incorporated by reference herein.

FEDERALLY SPONSORED RESEARCH AND DEVELOPMENT

Not applicable.

BACKGROUND OF THE INVENTION

1. Field of the Invention

The present invention is a laser firearm sight apparatus that attaches via the existing external threads on a muzzle of a firearm. More particularly, the invention is a laser rifle sight apparatus having a housing, a light source having a plurality of lasers, and an activating mechanism for selectively activating and powering the light source, with the housing being removably coupled to the external threads of a rifle muzzle, a pistol muzzle, or an air gun muzzle. The lasers emit beams that are concentric and parallel with the muzzle and the bore of the firearm when firing a projectile.

2. Description of Arguably Related Art Including Information Disclosed for 37 CFR 1.97 and 1.98

A firearm, for example, a rifle or a pistol, generally has a barrel having a muzzle at the proximal end of the barrel, and a bore extending the length of the barrel, with a projectile traveling the length of the barrel and being emitted from the muzzle. Laser attachments or laser sight apparati or devices are often installed on or to a firearm to provide a light source, usually a single laser emitting a single beam, which is aimed at a target. Many conventional laser sights are installed below or beside the barrel of the firearm. These locations cause the single laser beam and the direction of the projectile, namely a bullet, to cross at some point. Therefore, conventional laser sights lack the accuracy and precision needed for aiming the barrel of the firearm at the target of interest so that the projectile makes impact with a target throughout a range of distances. Some laser sight systems attempt to solve these deficiencies by aligning a single laser emitting a single laser beam along the longitudinal axis of the gun barrel. An example is U.S. Pat. No. 6,295,753 issued to Thummel. These laser sights are attached to the end of the existing barrel of the firearm so that the single laser beam is coaxially aligned with the bore of the barrel.

A need exists for an improved laser firearm sight apparatus that has a light source, an activating mechanism for activating and powering the light source, and a housing that attaches onto or couples to the threaded end of an existing muzzle of a firearm; wherein the housing keeps the light source beam in line with the bore of the firearm barrel to prevent the laser beam and the direction of the projectile from crossing paths, with such crossing impacting the accuracy and precision of aiming the projectile at a target of interest.

A need exists for an improved laser firearm sight apparatus that has a housing removably coupled to the existing external threads of a firearm muzzle, a light source having a plurality of lasers with the lasers emitting laser beams concentric and parallel with the muzzle and bore of the firearm to keep a projectile in the center of the projected laser beams, and an activating mechanism for activating the light source when live firing the firearm.

A need exists for an improved laser firearm sight apparatus utilizing a plurality of laser beams that are concentric and in plane with the bore of the muzzle of a firearm, thereby preventing the projectile and laser beams from crossing paths at one particular point and becoming inaccurate.

A need exists for an improved laser firearm sight apparatus having a housing capable of being installed on the muzzle and used with different firearms, with the light source retaining its accuracy until gravity pulls the projectile below the plane of the laser beams once the projectile reaches a distance far from the firearm.

A need exists for an improved laser firearm sight apparatus that is lightweight, compact, portable, sturdy, and easy to install onto the muzzle of any firearm that has compatible threads to receive the apparatus housing.

A need exists for an improved laser firearm sight apparatus that is cost-effective to manufacture.

SUMMARY OF THE INVENTION

In one embodiment, the invention provides a firearm sight apparatus that comprises (includes or has) a housing supporting a light source, with the housing having a coupling member for coupling the housing to the muzzle of a firearm barrel; the light source having at least two illuminating members, with each illuminating member being positioned and spaced apart in a ring configuration around the housing so that the emitted light beams form a ring toward a target when aiming a projectile from the firearm muzzle bore; and an activating mechanism for activating and powering the light source.

The laser firearm sight apparatus has a housing having a universal coupling member so that the housing can be installed onto the muzzle of several different types of firearms, with those firearms having compatible threads. The light source maintains its accuracy without further adjustments. The coupling member is essentially the housing defining a central longitudinal bore, with the bore having at least one end with machined internal threads for rotatably coupling to the existing external threads of the muzzle of a firearm barrel. The coupling means may further include fasteners for removably fastening the housing to the muzzle. Alternatively, the coupling member may have a press-on member rather than using fasteners for securing the housing to the firearm muzzle. The illuminating members are preferably lasers. The lasers are positioned around the housing to circumscribe the muzzle bore of the firearm barrel so that the user can determine where a projectile will make impact with a target. The activating mechanism has a power source and a switching member that are each in communication with the light source.

In yet another embodiment, the laser firearm sight apparatus has (a) a frustoconical, cylindrical, or rectangular shaped housing having a plurality of slots for receiving one of a plurality of illuminating members, with the housing defining a bore therethrough with at least one end of the bore being internally threaded for coupling to the externally threaded end of the muzzle of a firearm barrel; and (b) an activating mechanism for activating and powering the illuminating members. The housing may further include a plurality of grooves and a plurality of apertures for receiving fasteners.

Once installed, the user can turn on the light source with the activating mechanism, and can align the plurality of laser beams at the target to determine where the projectile will make impact without making additional adjustments to the laser rifle sight. The laser beams form a concentric ring around the target and, once triggered, the projectile will make impact within the center of the ring of laser beams. Once finished, the housing can be easily removed and attached to the muzzle of a different firearm barrel without making additional adjustments to the light source or to the new firearm laser sight.

The apparatus provides a user with more precision and accuracy when aiming toward a target. The apparatus is more practical and easier to use than other conventional laser firearm sights. One distinguishing feature is that this apparatus employs a plurality of lasers that are concentric and parallel to the bore of the firearm barrel to essentially form a ring around the target for firing a projectile. This is in contrast with conventional laser firearm sights which emit a single beam either above or below the firearm barrel. Those devices only allow for the projectile to cross the path of the laser at one single point, diminishing accuracy at other distances. The beams from the illuminating members encapsulate the path of a projectile toward the target at a distance X until the projectile begins to fall away from the plane of the barrel and the illuminating members' beams as the projectile reaches a distance Y from the firearm. The housing is capable of being installed on different muzzles of different firearms without further adjusting the housing as a sight apparatus.

The invention is distinguishable in its structural components, design, arrangement, and function for use as a laser sight for a firearm, wherein the laser sight encapsulates the bore of the firearm muzzle to form a concentric ring of laser beams aimed at a target.

It is an object of the invention to provide an improved laser firearm sight apparatus that has a light source, an activating mechanism for activating the light source, and a housing that attaches onto or couples to the threaded end of an existing muzzle of a firearm; with the housing being attachable onto the muzzle to keep the laser beams in line with the bore of the firearm barrel to prevent the laser beams and the direction of the projectile from crossing paths, with such crossing impacting the accuracy and precision of aiming the projectile at a target of interest.

It is another object of the invention to provide an improved laser firearm sight apparatus that has a housing removably coupled to the existing external threads of a firearm muzzle, a light source having a plurality of lasers with the lasers emitting laser beams concentric and parallel with the muzzle and bore of the firearm to keep a projectile in the center of the projected laser beams, and an activating mechanism for activating the light source when firing live projectiles.

It is yet another object of the invention to provide an improved laser firearm sight apparatus utilizing a plurality of laser beams that are concentric and in plane with the bore of the muzzle of a firearm, thereby keeping the projectile in center of the beams and preventing the projectile and laser beams from crossing paths at one particular point and becoming inaccurate.

It is an object of the invention to provide an improved laser firearm sight apparatus having a housing capable of being installed on different muzzles and being used with different firearms, with the light source retaining its accuracy until gravity pulls the projectile below the plane of the laser beams once the projectile reaches a distance far from the firearm.

It is another object of the invention to provide an improved laser firearm sight apparatus that is lightweight, compact, portable, sturdy, and easy to install onto the muzzle of a firearm barrel.

It is an object of the invention to provide an improved laser firearm sight apparatus that is cost-effective to manufacture.

These and other aspects, objects, embodiments, and advantages of the invention will become apparent from the accompanying drawing and the following detailed description of the preferred embodiments of the invention.

BRIEF DESCRIPTION OF THE SEVERAL VIEWS OF THE DRAWING

The invention may be more readily described by reference to the accompanying drawing figures and the following description of the drawing figures. The reference numbers apply to each embodiment of the invention. In the drawing.

Figure 1:
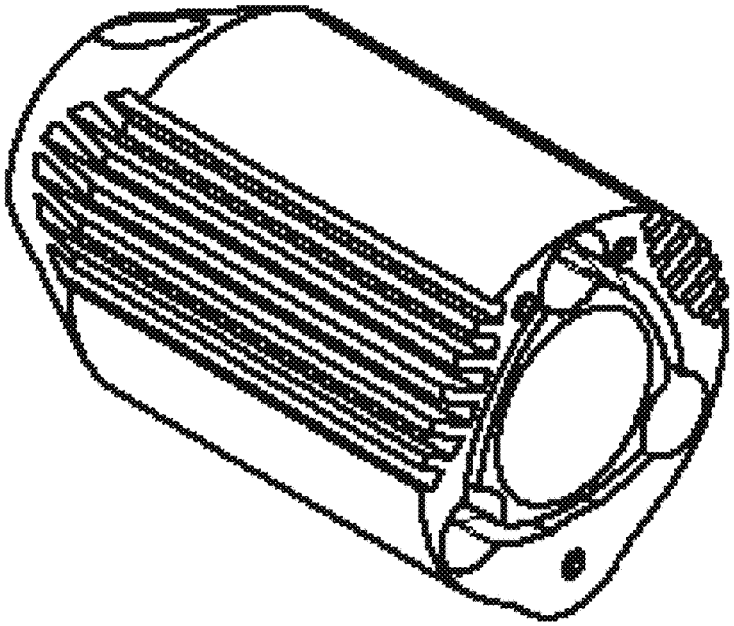
FIG. 1 is an isomeric view of an embodiment of the invention.
Figure 2:
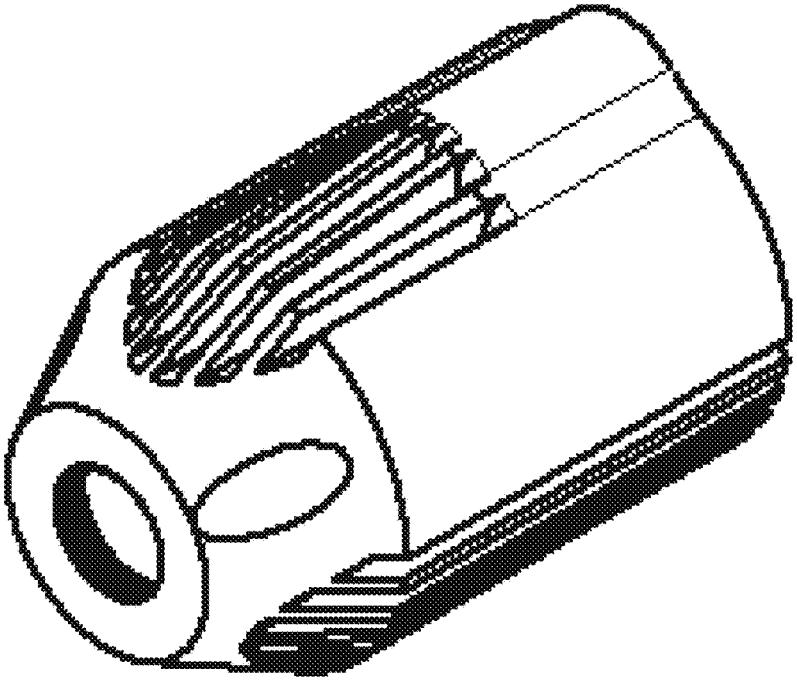
FIG. 2 is another isomeric view of FIG. 1 thereof.
Figure 3:
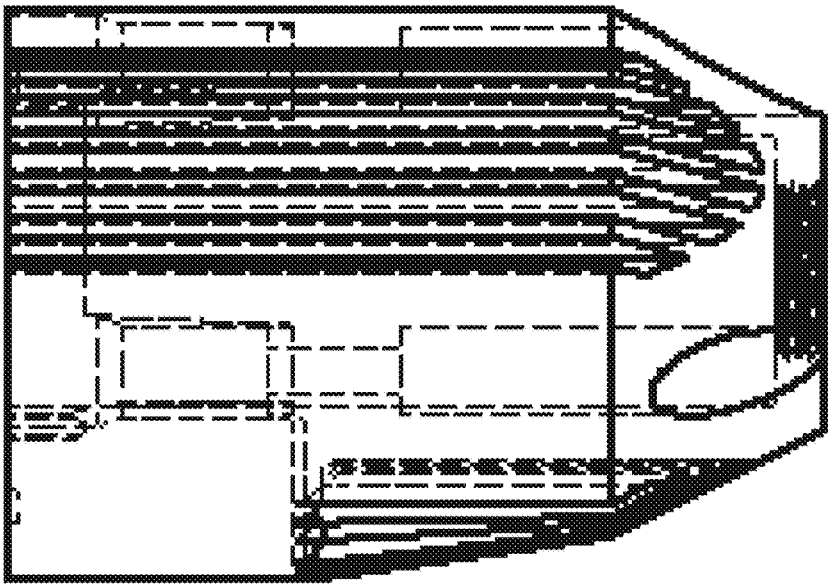
FIG. 3 is a first side elevation view of FIG. 1 thereof, with a second side elevation view being a mirror image.
Figure 4:
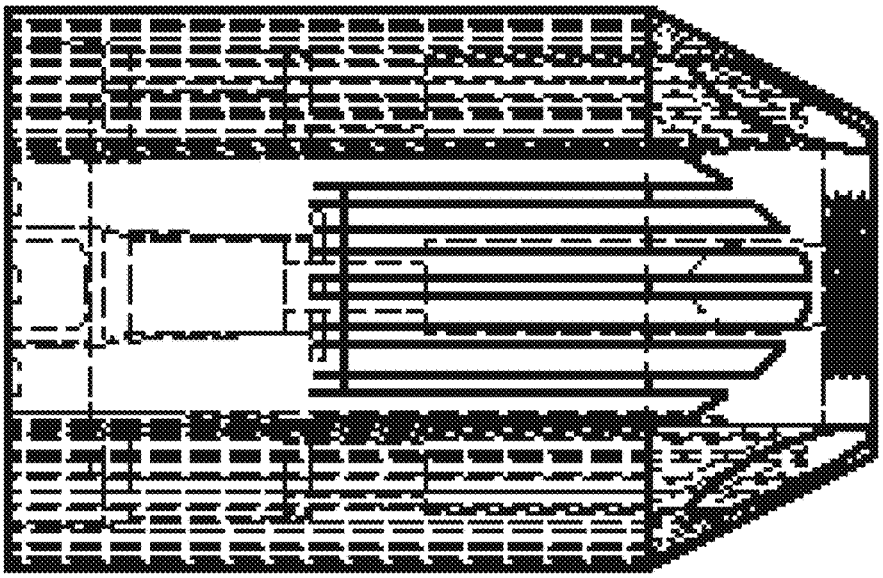
FIG. 4 is another first side elevation view of FIG. 1 thereof also showing the internal components of the housing, with a second side elevation view being a mirror image.
Figure 5:
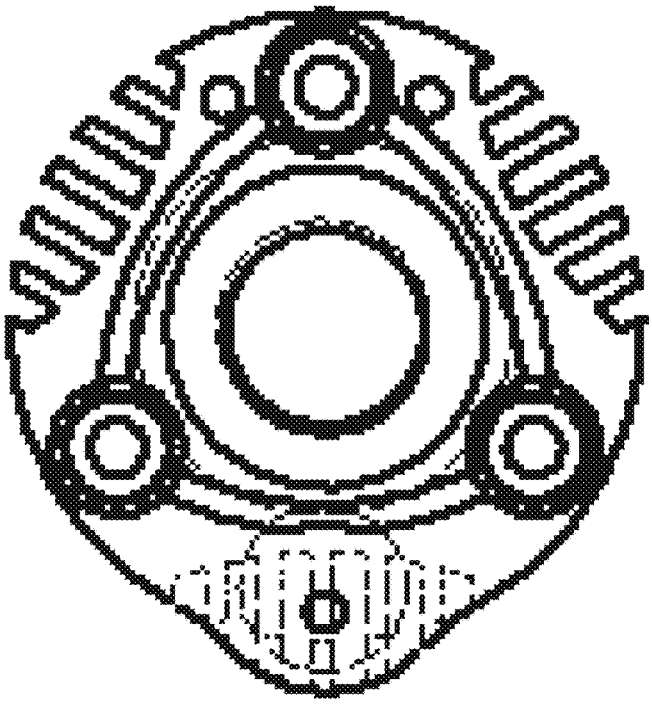
FIG. 5 is a top plan view of FIG. 1 thereof.
Figure 6:
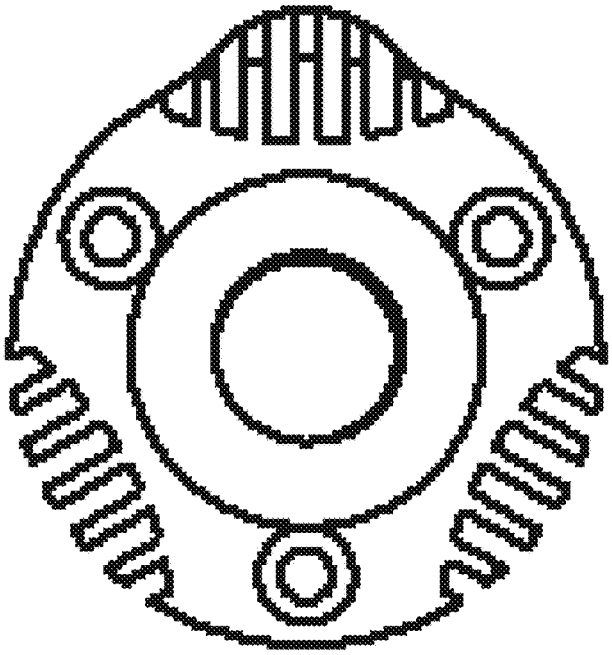
FIG. 6 is a bottom plan view of FIG. 1 thereof.
Figure 7:
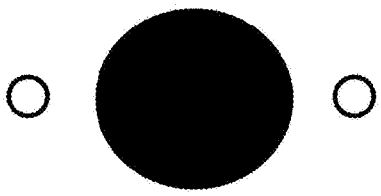
FIG. 7 is a schematic of an embodiment of the invention, showing the light source having two light beams aimed at a target.
Figure 8:
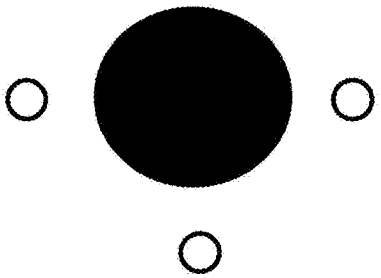
FIG. 8 is a schematic of an embodiment of the invention, showing the light source having three light beams, forming a triangular configuration, aimed at a target.
Figure 9:
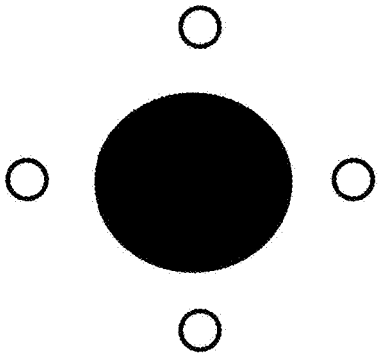
FIG. 9 is a schematic of an embodiment of the invention, showing the light source having four light beams, forming a concentric ring configuration, aimed at a target.
Figure 10:
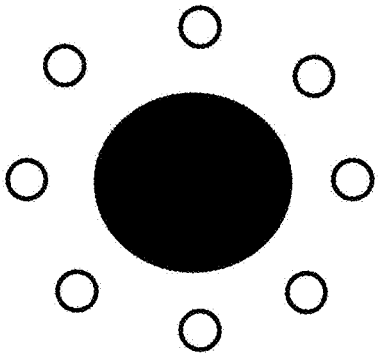
FIG. 10 is a schematic of an embodiment of the invention, showing the light source having a plurality of light beams, forming a concentric ring configuration, aimed at a target.
Figure 11:
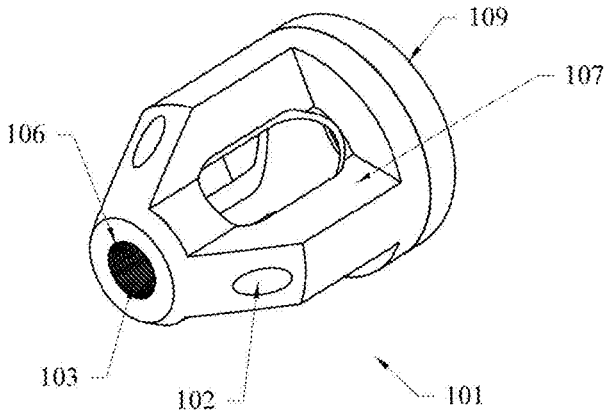
FIG. 11 is a perspective view of another embodiment of the invention.
Figure 12:
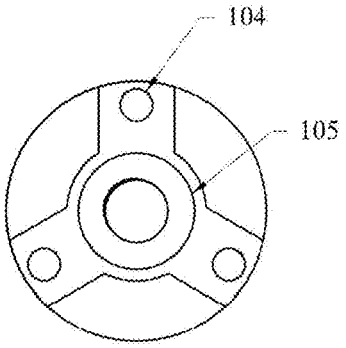
FIG. 12 is a top plan view of FIG. 11 thereof.

The broken lines in the drawing concerning the firearm and flash hider are for illustrative purposes only.

DETAILED DESCRIPTION OF THE INVENTION

The present invention, preferred embodiments of the invention, and the accompanying drawing figures as described herein should not be construed as limited to the illustrated drawing. Rather the illustrated embodiment(s) are detailed to provide a thorough disclosure suitable to convey the scope of the invention to those skilled in the art. For the sake of simplicity, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

Referring more particularly to the drawing by characters of reference, the figures depict an embodiment of the invention of a laser firearm sight apparatus comprising (a) a housing 1; (b) a light source 2 having a plurality of illuminating members, each preferably a laser, with the illuminating members arranged about the housing to emit concentric and parallel light beams with the muzzle of a firearm barrel and the bore of the firearm barrel, with the illuminating members being arranged and configured in a concentric ring to keep a projectile and a target in the center of the projected light beams; (c) a coupling means for removably coupling the housing to or onto the muzzle of a firearm barrel; and (d) an activating mechanism for activating and powering the light source when firing the firearm.

In another embodiment, a laser firearm sight apparatus comprises (a) a housing 1 having a head and a body, with the housing having a plurality of grooves 7 spaced around the body of the housing, at least three slots 4 spaced around the housing head and body with each of the plurality of slots for receiving a light source 2, and a plurality of apertures 8 defined in the housing body for receiving one of a plurality of fasteners 9; (b) a coupling means having the plurality of fasteners 9 for fastening the housing to the muzzle of the firearm barrel, with the housing body further defining a longitudinal bore 3 for coupling the housing 1 to the muzzle; (c) a light source having three or more illuminating members 2, each positioned on or in the housing to circumscribe the housing bore 3; (d) an activating mechanism for selectively activating the light source and for powering the light source; and (e) wherein the housing may be installed on different muzzles of different firearm barrels without making further adjustments to the apparatus after installation. The firearm may be, but is not limited to, rifles, pistols, air guns, or air rifles. When the firearm is a rifle, the housing is installed behind the muzzle away from the hot gas and muzzle blast. When the firearm is a pistol the housing protrudes from the muzzle. The projectile includes, but is not limited to, a bullet, a BB, or a pellet. The apparatus can be attached to the end of a variety of muzzles and can be used as a sight device.

Figure 13:
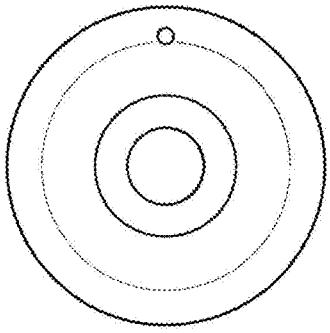
FIG. 13 is a bottom plan view of FIG. 11 thereof.

The housing may be manufactured from aluminum. The housing may also be made from a cast metal material as a cost-effective alternative to aluminum. Alternatively, the housing may be made from molded plastic or a plastic-type material, or fabricated from a 3D printer. The housing is lightweight, compact, portable, sturdy, and easy to install onto the muzzle of a firearm barrel. The housing may be easily handled and installed as an auxiliary attachment to an existing firearm barrel. In FIGS. 15-20, the apparatus essentially acts as an extension of the firearm muzzle, with the added benefit of using a plurality of lasers that emit a ring of laser beams around the housing bore, the muzzle bore, and the target for sight line of the target. In FIGS. 13, and 28-29, the housing attaches onto the muzzle to keep the laser beams in line with and parallel to the bore of the firearm barrel. This arrangement prevents the laser beams and the direction of the projectile from crossing paths at one particular point and becoming inaccurate.

The housing couples to the existing threaded end of the muzzle of the firearm barrel so that the line of sight of the light beams does not cross the path of the projectile. As shown in the figures, the housing is preferably configured into a frustoconical shape. Alternatively, the housing may have a square or rectangular configuration (not shown). In a preferred embodiment, the internally threaded bore of the housing is ½ inch×28. The housing bore can be manufactured to accommodate a larger or smaller caliber firearm. For example, the housing bore can be manufactured for coupling a ⅝ inch 24 threaded coupling means to a standard .30 caliber barrel on a firearm. Adjusting the size of the housing bore to correspond with the respective size firearm barrel will not negatively impact the function the apparatus. There would be no shift in point of impact when the apparatus is installed.

The head of the housing 1 has at least one slot 4 and a longitudinal bore 3 defined through the head of the housing and through the length of the body. Preferably, the head of the housing has a plurality of slots that are spaced apart and arranged around the head of the housing, with each of the slots receiving one of the plurality of illuminating members 2. The top of the housing 1 may further have a lip 5 that circumscribes the opening of the bore 3. In one embodiment, the lip may overhang over the downwardly contoured head of the housing.

As shown in FIGS. 1 and 5-8, the bore of the housing has a body, an interior hollow chamber, and opposing ends. The bore is an opening that extends along the length of the housing from the top of the housing to the bottom. At least one end of the bore 3 is internally threaded 6 for removably coupling to the existing threaded firearm muzzle and pistols. The internally threaded ends of the bore are preferably machined. The diameter of the bore body (chamber) may be designed larger than the actual barrel diameter of the firearm. The bore body is larger than the threaded end of portion the bore. The spacing between the larger bore body and the installed firearm muzzle creates an air gap. This air gap acts as an insulator against heat. The air gap may be formed on heavy barreled rifles or other firearms. The bore has a diameter sized to receive the appropriate projectile that is ejected from the firearm barrel without interfering with the direction or speed of the projectile.

The plurality of slots is essentially arranged around the head of the housing to form a ring or a concentric configuration around the housing bore. Each of the slots may extend through the length of the housing. The slots may be arranged at any location on the housing, as long as the overall concentric configuration is maintained. The slots are essentially cutouts in the head of the housing, with each slot for receiving one of the illuminating members.

In the embodiment shown in FIGS. 1-16, the coupling means is essentially the housing bore 3, at least an aperture 8 on the housing 1, and a corresponding fastener 9. The body of the housing has a plurality of apertures with each of the apertures receiving one of a plurality of fasteners. The plurality of apertures may be spaced around the lower section of the housing body. Each of the apertures engages with or holds the fasteners to or against the firearm muzzle. The fasteners may be screws, bolts, or any other conventional fastener or combinations of any of these types of fasteners.

The housing 1 may further have a plurality of grooves 7 that are spaced around the body of the housing. The plurality of grooves creates surface area to dissipate heat. The grooves also minimize the overall weight of the housing. In one embodiment shown in FIGS. 1-8, the plurality of grooves may be configured as vertical grate members. In another embodiment shown in FIGS. 9-16, the plurality of grooves may be configured as hollowed columns, arches, or pockets. The top of each of the grooves sections may have an arched configuration to further minimize weight of the housing. The arched portion provides for a smaller housing. The arched portion may also be used to hold an internal battery. In an embodiment where the housing body does not include any of the grooves (not shown), more material of the housing body is eliminated to minimize weight of the apparatus.

The light source may have two or more of a plurality of illuminating members or light emitting members. In a preferred embodiment, the light source has three illuminating members. The illuminating members are preferably lasers. Each laser emits a beam from its location in a corresponding slot in the housing and is in the same plane as the firearm muzzle bore. The light emitted from the lasers may use different wattages. The lasers may also emit a red, green, or infrared beam. Each laser light may be replaced by the manufacturer rather than the user to maintain accuracy of the laser. The laser beams encapsulate the projectile's path until the projectile begins to fall away from the plane of the barrel and the laser beams due to gravity as the projectile reaches a distance far from the firearm. The plurality of laser beams that circumscribe the housing bore and the projectile provide more accuracy. This apparatus is distinguishable from sight light laser devices that only utilize a single laser. One laser will not encapsulate the muzzle bore and the projectile. For greater distances, other auxiliary sight line attachments are used with single laser devices. Also, the apparatus is distinguishable from conventional bore sights because bore sights are used to get a scope relatively close before live firing. Bore sights are not to be used during live firing projectiles. Alternative light sources include LEDs or infrared lights.

The activating mechanism further includes a power source 10 and a switching member 11. The power source provides power to the illuminating members. The power source (not shown) may include a compartment that contains an internal battery, an external battery or power source, or both. The switching member 11 may be a pressure pad, toggle button or switch, or other switching member to selectively activate the illuminating members. The power source is in connectivity with or in communication with the switching member. The switching member is also in connectivity with or in communication with each of the illuminating members. The switching member may further include a circuit board or other electronic components for operating the light source (not shown). The switching member may be mounted to or positioned on the housing. Alternatively, as shown in FIGS. 11 and 13-15, the switching member may be mounted to or positioned on the power source, with wiring connecting the power source to the light source within the housing. When the power source and switching member are wired in the apparatus, the wiring may extend through the bottom of each of the respective slots and into the housing.

In an embodiment shown in FIGS. 21-31, the laser firearm sight apparatus comprises a housing, a light source, and an activating mechanism. Here, the housing has a head, a body, and a coupling member. The head of the housing defines a bore that has an internally threaded proximal end. The body of the housing has a chamber, a plurality of slots, and a bottom of the body of the housing. The body of the housing extends from the head at least before extending downwardly and perpendicular to the bottom of the housing body. The chamber is essentially a hollow opening and is aligned with the bore. The chamber is configured with a larger interior than the bore proximal end. The chamber preferably has a diameter interior larger than the firearm barrel for use as an insulating "air gap," with the chamber defining at least three cutouts 107 extending longitudinally from the head of the housing to the bottom of the housing body. The cutouts aid in the housing being lightweight. The plurality of slots shown in this embodiment is preferably three slots defined in the body and extending the length of the body. Each of the slots and the distal open end of the chamber terminate at the bottom of the housing body, with the slots extending the length of the body in a concentric ring about the body bottom.

Figure 25:
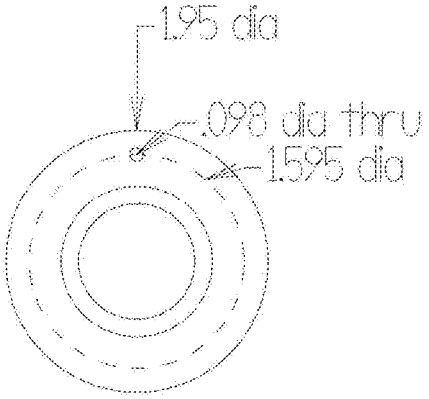
FIG. 25 is a bottom plan schematic of FIG. 22 thereof, with the coupling member installed onto the housing body.
Figure 26:
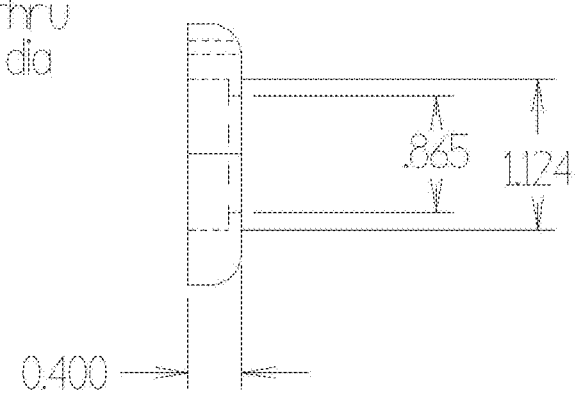
FIG. 26 is a partial side elevation view of FIG. 22 thereof, showing the coupling member.

As shown in FIG. 25, the bottom of the body has a rim 112 separated by a recessed member 104, and further having an upstanding, externally threaded circular support member 113 with the support member 113 having an opening therethrough larger than the bore opening at the top of the housing. The coupling member 108 defines an internally threaded hole to rotatably engage with the support member 113. The coupling member is adapted to press into or onto the firearm muzzle without fasteners. The coupling member affixed or otherwise permanently mounted to the bottom of the housing body.

The light source in this embodiment has a plurality of illuminating members, with one of the plurality of illuminating members being positioned within one of the plurality of slots, with each illuminating member being in communication with and being controlled by the activating mechanism. Each of the illuminating members may be selected from the group of lasers, LEDs, or infrared lights, as shown in FIGS. 21-31, the housing has three slots and the light source is three lasers. Each of the slots receives one of the lasers, with the slots being configured in a concentric ring about the housing so that the laser beams encapsulate the firearm muzzle and the target, as shown in the target pattern of FIGS. 15-20.

The activating mechanism in this embodiment has a power source, a switching member, and a controller. The power source powers the light source, with the power source also being in communication with the switching member. The switching member is in communication with the light source via the power source to selectively activate the light source. The controller contains the switching member and the compartment or enclosure member that contains the switching member, the power source, and any other electric and/or electronic components that aid in operating the apparatus. The light source may be wired to the switching member within the controller, or alternatively, connected wirelessly or remotely to the switching member within the controller.

As shown in FIG. 30, when the switching member is wired to the illuminating members, preferably via the power source, the switching member is in connectivity with each of the illuminating members within the housing on a first end of the switching member though the coupling member aperture 111 and in connectivity with a selectively activated pressure pad or toggle member 109 within or on the controller 110 on a second end of the switching member. In a wireless version of the invention shown in FIG. 31, for example for use with an air gun, the switching member is in direct connectivity with the light source and the power source, and further has a receiver (not shown) for receiving remote or wireless activation signal from a transmitter 114 located within or on the controller 110.

The power source (not shown) is preferably at least one battery coupled to or otherwise in communication with each of the illuminating members positioned within each of the housing slots. When the apparatus is used on certain firearms, for example, on an AR-15 rifle, the battery is preferably located within the controller compartment rather than directly on or within the apparatus housing because the heat generating from the barrel may compromise the structure of the battery. Therefore, in those situations, the battery is located within the controller compartment with a hardwire connection to the light source within the housing. The wiring extends from the controller compartment 110 through the coupling member aperture 114 and into the housing to connect to the light source. The apparatus would be mounted onto the firearm barrel independently from the power source, switching member, and controller. Preferably, the apparatus' light source is wired to and in direct communication with the power source and with the switching member, both of which are located within the controller. In this instance, the switching member is essentially a switch or relay coupled to a toggle member or pressure pad member at the controller for the user to selectively actuate the light source. The controller is preferably a handheld device.

In a wireless version of the third embodiment of FIG. 31, the preferred firearm is an air gun without live ammunition. The housing with the laser light source has an internal receiver and powered by at least one battery. The controller has a wireless transmitter that sends a signal to the receiver, which actuates the lasers. The pressure pad or toggle switch may be mounted directly on the apparatus housing, or it may be included as a separate controller compartment.

The exact sizing and dimensions of the housing, the housing bore, and the body chamber for the apparatus is configured for a particular caliber firearm barrel so that the apparatus can be used on different muzzles of the same caliber firearm barrel. Regardless of the dimensions of the apparatus for use with a particular caliber firearm barrel, the structure, arrangement, and function of the apparatus remains proportional to the example apparatus described herein. For an example as shown in the schematic drawing in FIGS. 32-36, each slot near the top of the housing has a 120 degree angle from the end of the housing, and is at least 0.242 inches in diameter. The width of the coupling member is 0.400 inches. The underside of the coupling member has a pinpoint hole for inserting the wired connection therethrough, with the hole being 0.098 inches diameter through. The outer end of the coupling member has a 1.95 inch diameter, and the inner ring has a 1.595 inch diameter. The bore has at least ½-28 threads. The opening in the chamber has a length of at least 1.390 inches and a radius of 0.3125 inches. The bottom of the body has a 1.70 inch diameter counterbore that is 0.140 inches wide and 0.100 inches in depth. The bottom of the body has a 1.125 inch diameter aperture for receiving the wiring, with the exact sizing of the aperture opening depending on the selected caliber firearm used. The terminating slot opening has a 0.325 inch diameter that is 1.00 inches in depth. The inner ring has 0.865 inch diameter that is 1.98 inches in depth.

Figure 14:
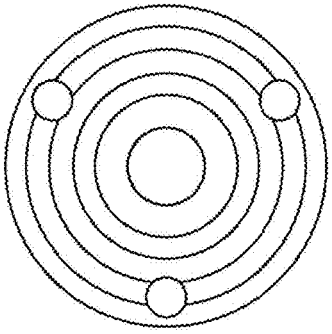
FIG. 14 is a bottom plan view of FIG. 11 thereof, with the coupling member removed to show the bottom of the housing.
Figure 15:
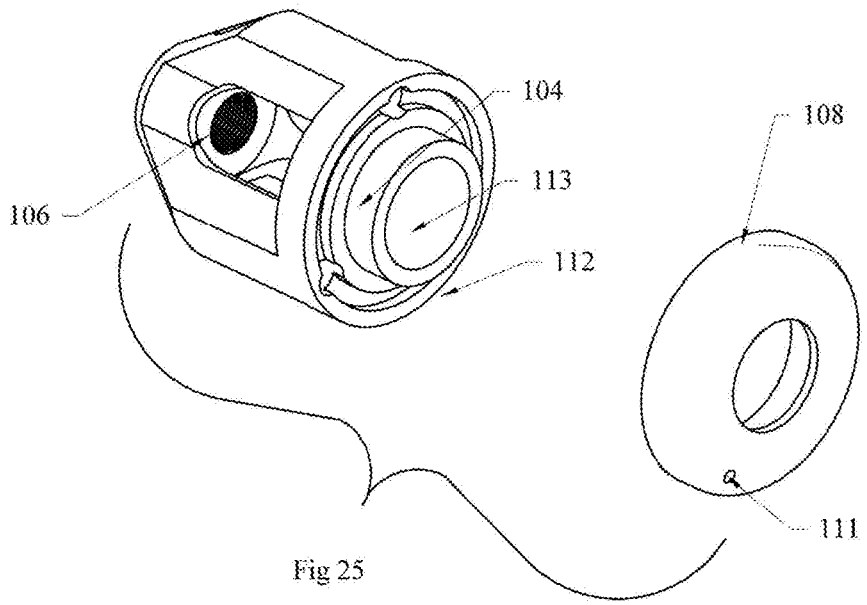
FIG. 15 is a bottom perspective view of FIG. 11 thereof, with the coupling member removed.
Figure 16:
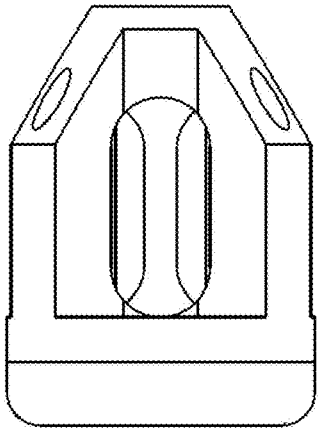
FIG. 16 is a first side elevation view of FIG. 11 thereof.
Figure 17:
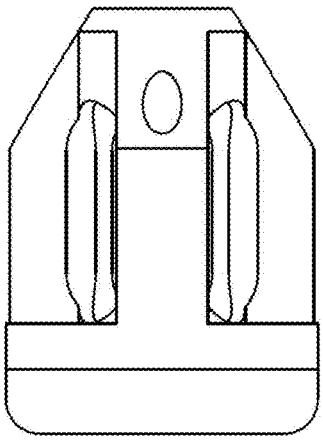
FIG. 17 is a second side elevation view of FIG. 11 thereof.
Figure 18:
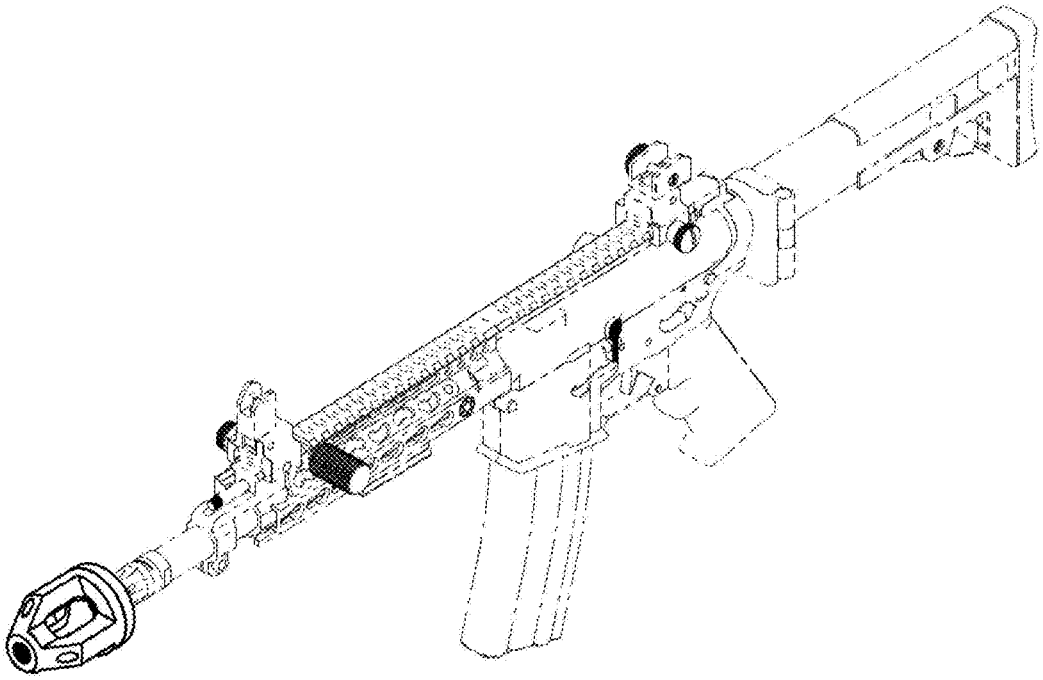
FIG. 18 is a perspective view of FIG. 11 thereof, showing the invention in use on a firearm.

To install and operate the sight line laser firearm sight apparatus shown in FIGS. 13-15, the user removes any auxiliary attachments from the existing threaded end of the firearm muzzle (FIG. 12), then rotatably attaches the housing's internally threaded bore onto the firearm muzzle. Each of the fasteners press is inserted into each respective housing aperture and secured to the muzzle.

To install and operate the laser firearm sight apparatus shown in FIGS. 21-31, the user removes any auxiliary attachments from the existing threaded end of the firearm muzzle. The housing body rotatably attaches onto the external threads of the firearm muzzle via the housing internally threaded bore and the chamber. A flash hider or other accessory may be installed onto the muzzle at the proximal end of the housing. The lasers are activated by the switching member on the controller. The firearm is aimed at the target of interest, with the target positioned within the center of the concentric laser beams, then the projectile is released from the firearm.

In each embodiment, the lasers may be activated by selecting or pressing a pressure pad, toggle switch, or other switching member. The user may make adjustments and check the sight line of the laser beam when compared with the target of interest. The ring of the plurality of laser beams is aimed at a target, with the target aligned within the central space of the laser beams. The apparatus is used for firing a projectile at a target with the aid of the laser beams or other light source, namely, LEDs or infrared lights. Now the firearm is ready for firing and accurately hitting the target at close distances. A user may remove an existing flash hider or suppressor from the muzzle before installing the instant apparatus. The user may then install the flash hider or suppressor onto or to the firearm muzzle after the apparatus. When the firearm is a pistol, the housing protrudes slightly from the muzzle due to the shortened length of the pistol muzzle.

Figure 19:
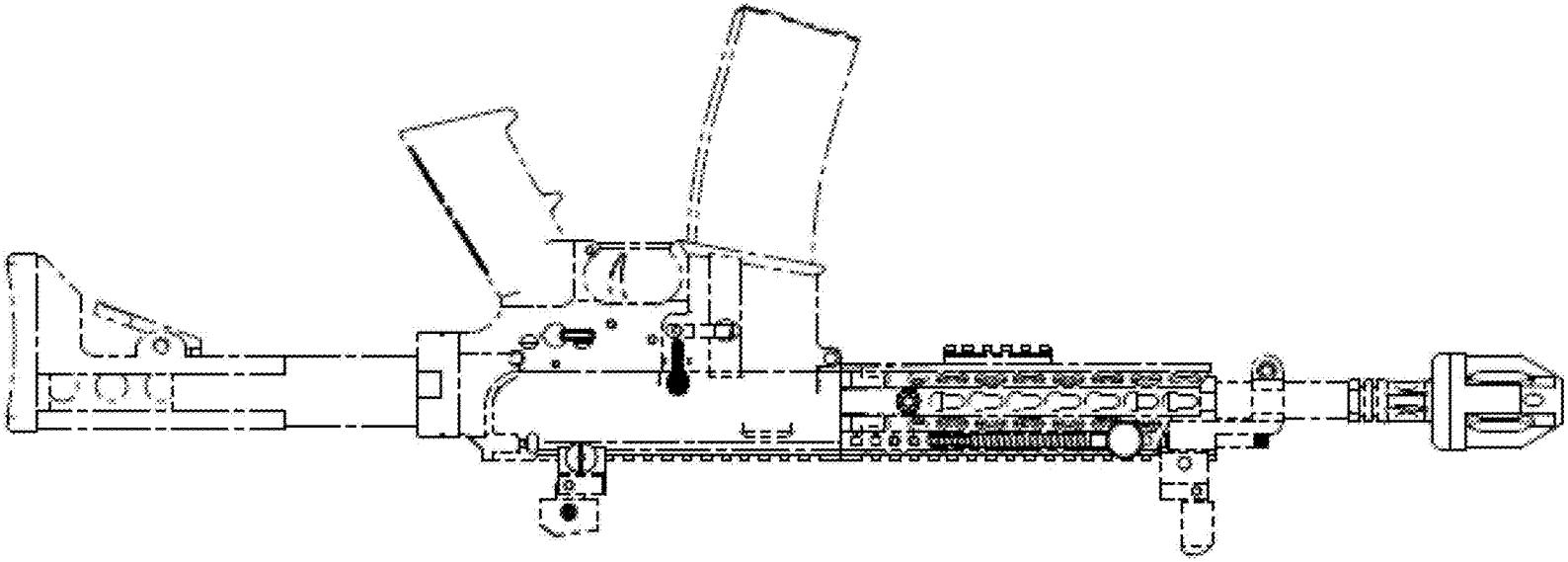
FIG. 19 is a first side elevation view of FIG. 18 thereof.
Figure 20:
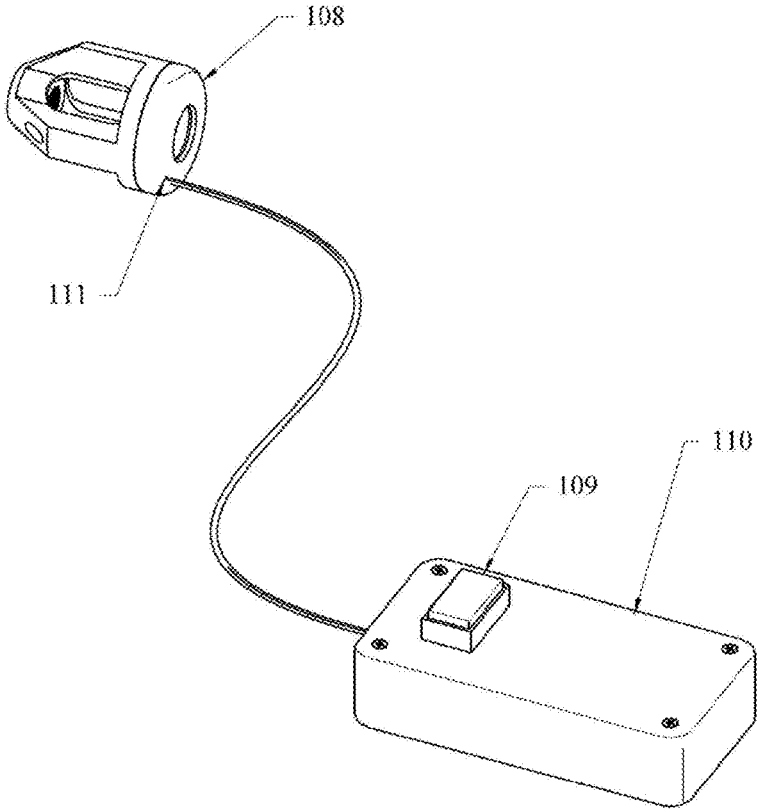
FIG. 20 is a perspective view of FIG. 11 thereof, showing the controller connected to the light source through the housing.
Figure 21:
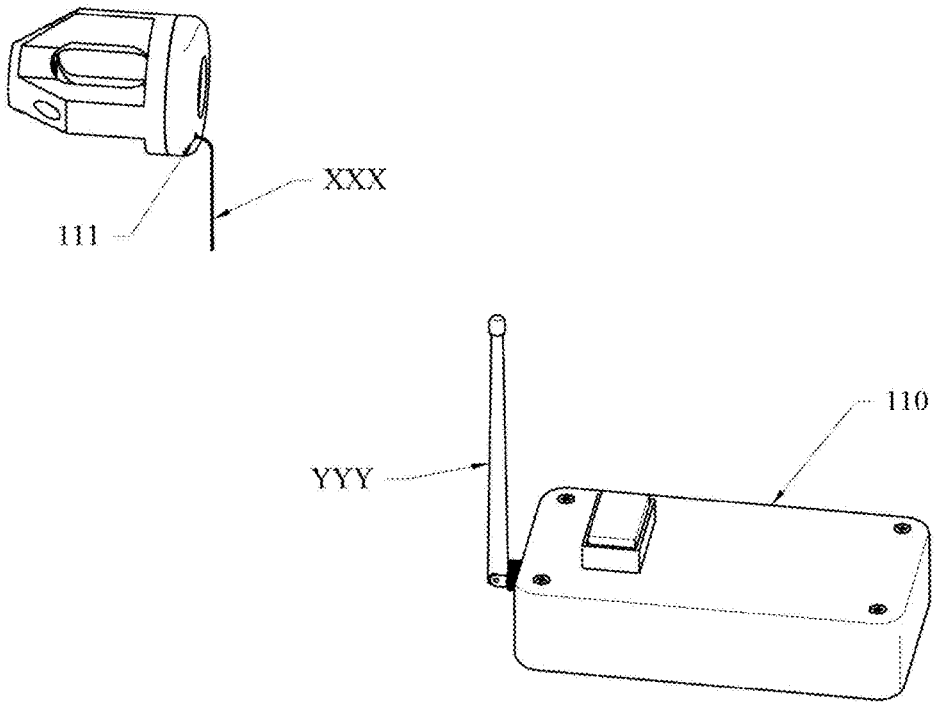
FIG. 21 is a perspective view of FIG. 11 thereof, showing controller wirelessly connected to the light source through the housing.
Figure 22:
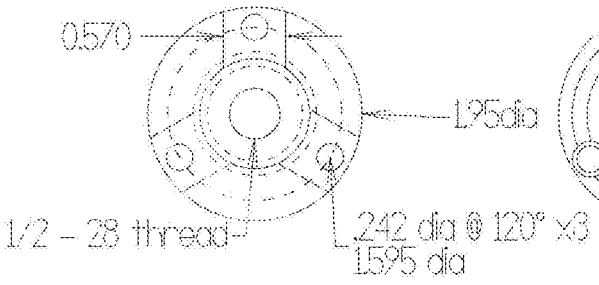
FIG. 22 is a top plan of FIG. 11 thereof, showing dimensions for the apparatus.
Figure 23:
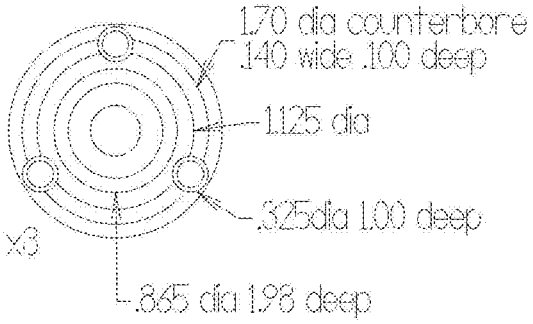
FIG. 23 is a bottom plan of FIG. 22 thereof, with the coupling member removed.
Figure 24:
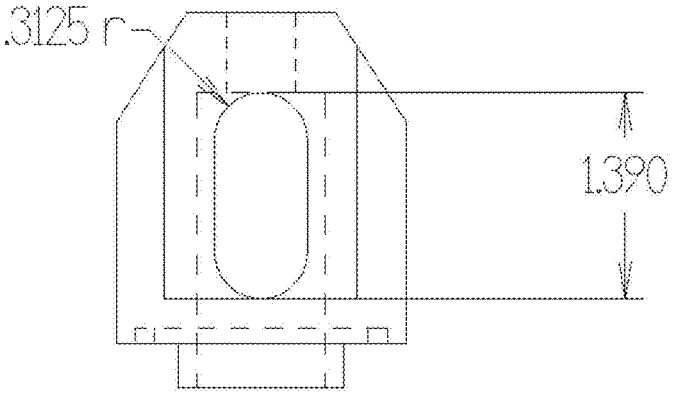
FIG. 24 is a side elevation view of FIG. 22 thereof.

In an example, the housing may be mounted onto an AR15 style rifle that further has a scope. The existing rifle scope can be sighted for accuracy at a great distance, for example, approximately 200 yards. The apparatus makes the firearm accurate at shorter distances when a user needs to shoot a target between approximately 10-75 yards without making adjustments to the apparatus or to the firearm. Without the apparatus, the user will have to make adjustments to the existing rifle's scope in order to accurately shoot at shorter distances. The projection of the laser beams may be on each side of the target and projectile when only two lasers are used (FIG. 17), in a triangular shape when only three of the lasers are used (FIGS. 16 and 18), or in a ring when a plurality of lasers are used (FIGS. 19-20). The projectile will remain substantially centered and circumcenter of the ring shape or the triangular shape until the projectile falls from the plane of the muzzle barrel. At this point, a more accurate decision would be to use the rifle scope for greater accuracy, which may occur around 200 yards.

Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein, to the extent of such reliance upon this disclosure.

We claim:

1. A firearm sight apparatus comprising:

a. a housing comprising a body and a coupling member, with i. a proximal end of the housing defining an internally threaded bore configured for rotatably engaging onto a muzzle of a firearm barrel having external threads;

ii. the body of the housing having a distal end with a bottom, and the body further defining a plurality of slots, defining an opening at the bottom of the housing body, and defining a hollow interior chamber, with the chamber having a distal opening and an opposing opening with the chamber openings each being aligned with the housing bore, with the chamber having a diameter larger than a diameter of the firearm barrel to create an air gap adapted as an insulator against heat from the firearm muzzle, and with the bottom of the housing body having the plurality of slots and the chamber distal opening each extending therethrough; and iii. the coupling member defining a hole corresponding to the bottom opening of the housing body for the chamber distal opening to receive a projectile therethrough, with the coupling member hole being affixed to the bottom of the housing body, and with the distal end of the housing body and the coupling member each being removably and slidably insertable over the threaded muzzle of the firearm barrel;

b. a light source having a plurality of illuminating members, one of each of the plurality of illuminating members being positioned within one of each of the plurality of slots, with each of the plurality of slots configured and arranged around the housing in a concentric ring, wherein each of the plurality of illuminating members emit a beam of light; and c. an activating mechanism having a switching member and a power source, with the switching member being in operative communication with the plurality of illuminating members to actuate each of the illuminating members, and with the power source being in communication with the plurality of illuminating members to power each of the illuminating members;

d. wherein, upon activation of the plurality of illuminating members, the firearm is aimed at a target of interest, with the target of interest being aligned within the concentric ring of the emitted beams from the illuminating members, wherein the beams from the illuminating members encapsulate the path of the projectile toward the target of interest at a distance X until the projectile begins to fall away from both the plane of the firearm barrel and the beams of the illuminating members as the projectile reaches a distance Y from the firearm; and e. wherein the housing is capable of being installed onto different muzzles of different firearms without further adjusting the housing for use as a sight apparatus.

2. The firearm sight apparatus of claim 1, the housing further comprising a frustoconical head with the housing bore defined centrally therethrough, with the housing body extending downwardly from the housing head, and with the coupling member further having a contoured distal portion.

3. The firearm sight apparatus of claim 1, the bottom of the housing body further comprising a rim and an upstanding externally threaded circular support member, with the circular support member being engageable with the coupling member, and with the bottom of the housing body further defining a recess.

4. The firearm sight apparatus of claim 1, the plurality of slots and the plurality of illuminating members comprising at least three slots and at least three illuminating members, with each of the illuminating members being selected from the group of lasers, LEDs, or infrared lights.

5. The firearm sight apparatus of claim 4, each illuminating member being a laser.

6. The firearm sight apparatus of claim 1, the switching member being in wired connectivity with each of the illuminating members via the power source, and with the coupling member further comprising an aperture to receive the switching member wire therethrough.

7. The firearm sight apparatus of claim 1, the switching member being in wireless connectivity with each of the illuminating members, wherein the activating mechanism further comprises a transmitter in communication with the switching member, and the light source further comprising a receiver that receives an actuating signal from the transmitter to actuate the light source.

8. The firearm apparatus of claim 1, the firearm being a rifle.

9. The firearm apparatus of claim 1, the firearm being a pistol.

10. The firearm apparatus of claim 1, the firearm being an air gun.

11. A laser firearm sight apparatus comprising:

a. a housing comprising a body and a coupling member, i. a proximal end of the housing defining an internally threaded bore configured for rotatably engaging onto a muzzle of a firearm barrel having external threads, and a distal end of the housing;

ii. the body of the housing having a bottom and a plurality of walls, and the body further defining a plurality of cutouts, defining an opening at the bottom of the housing body, and defining a hollow interior chamber, with the chamber having a distal opening and an opposing opening each of the chamber openings being aligned with the housing bore and with the chamber having a diameter larger than a diameter of the firearm barrel to create an air gap adapted as an insulator against heat from the firearm muzzle, with each of the plurality of walls defining a slot extending longitudinally therethrough to the bottom of the housing body, with distal opening of the chamber extending through the bottom of the housing body, and with the plurality of cutouts configured to expose the interior of the chamber; and iii. a coupling member defining a hole corresponding to the bottom opening of the housing body for the distal opening of the chamber to receive a projectile therethrough, with the coupling member hole being affixed to the bottom of the housing body, and with the distal end of the housing body and the coupling member each being removably and slidably insertable over the threaded muzzle of the firearm barrel;

b. a light source having a plurality of lasers, one of each of the plurality of lasers being positioned within one of each of the plurality of slots, with each of the plurality of slots configured and arranged around the housing in a concentric ring, wherein each of the plurality of lasers emit a beam of light; and c. an activating mechanism having a controller, a switching member, and a power source, with the switching member being in operative communication with the power source, with the power source being in communication with the plurality of lasers to power each of the lasers, and with the lasers being actuated by activating the switching member housed within the controller;

d. wherein, upon activation of the plurality of lasers, the firearm is aimed at a target of interest, with the target of interest being aligned within the concentric ring of the emitted lasers beams, wherein the laser beams encapsulate the path of the projectile toward the target of interest at a distance X until the projectile begins to fall away from both the plane of the firearm barrel and the laser beams as the projectile reaches a distance Y from the firearm; and e. wherein the housing is capable of being installed onto different muzzles of different firearms without further adjusting the housing as a sight apparatus.

12. The firearm sight apparatus of claim 11, the housing further comprising a frustoconical head with the housing bore defined therethrough, with the housing body extending downwardly from the housing head.

13. The firearm sight apparatus of claim 11, the bottom of the housing body further comprising a rim and an upstanding externally threaded support member, with the support member being engageable with the coupling member, and with the housing bottom further defining a recess.

14. The firearm sight apparatus of claim 11, the plurality of slots and the plurality of lasers comprising at least three slots and at least three lasers.

15. The firearm sight apparatus of claim 11, the switching member being in wired connectivity with each of the lasers via the power source, and with the coupling member further comprising an aperture to receive the switching member wire therethrough.

16. The firearm sight apparatus of claim 11, the switching member being in wireless connectivity with each of the lasers, wherein the activating mechanism further comprises a transmitter in communication with the switching member, and the light source further comprising a receiver that receives an actuating signal from the transmitter to actuate the light source.

* * * * *